US007530244B2

(12) United States Patent
Inuzuka et al.

(10) Patent No.: US 7,530,244 B2
(45) Date of Patent: May 12, 2009

(54) DRUM TYPE WASHING MACHINE

(75) Inventors: Tadashi Inuzuka, Hyogo (JP); Tsuyoshi Fukuda, Osaka (JP); Takashi Komatsu, Hyogo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 690 days.

(21) Appl. No.: 11/211,521

(22) Filed: Aug. 26, 2005

(65) Prior Publication Data

US 2006/0053838 A1 Mar. 16, 2006

(30) Foreign Application Priority Data

Sep. 13, 2004 (JP) ..... 2004-265002

(51) Int. Cl.
*D06F 37/22* (2006.01)

(52) U.S. Cl. ..... 68/24; 68/58; 68/140

(58) Field of Classification Search ..... 68/24, 68/58, 140; 134/184, 198
See application file for complete search history.

(56) References Cited

U.S. PATENT DOCUMENTS

| | | | | | |
|---|---|---|---|---|---|
| 2,296,259 | A | * | 9/1942 | Breckenridge | 68/24 |
| 2,661,620 | A | * | 12/1953 | Young | 68/23.3 |
| 2,813,415 | A | * | 11/1957 | Clark | 68/23.1 |
| 2,893,135 | A | * | 7/1959 | Smith | 34/610 |
| 3,356,222 | A | * | 12/1967 | Belaieff | 210/363 |
| 3,509,742 | A | * | 5/1970 | Bauer | 68/23.1 |
| 3,548,615 | A | * | 12/1970 | Toshikazu et al. | 68/23.1 |
| 5,207,081 | A | * | 5/1993 | Fuse | 68/23.1 |
| 6,557,383 | B1 | * | 5/2003 | Ito et al. | 68/23.2 |
| 7,293,313 | B2 | * | 11/2007 | Beier et al. | 8/159 |
| 2005/0144736 | A1 | * | 7/2005 | Jones | 8/158 |

FOREIGN PATENT DOCUMENTS

| | | | |
|---|---|---|---|
| CN | 1136107 | | 11/1996 |
| CN | 1243866 | | 3/2006 |
| JP | 61-98286 | | 5/1986 |
| JP | 05-084388 | * | 4/1993 |
| JP | 06-079098 | | 3/1994 |
| JP | 06-126074 | | 5/1994 |
| JP | 6-170080 | | 6/1994 |
| JP | 2001-170389 | * | 6/2001 |
| JP | 2003-079995 | | 3/2003 |
| KR | 2001082951 | * | 2/2000 |
| KR | 2004069133 | * | 8/2004 |
| WO | 03/098070 | * | 11/2003 |

OTHER PUBLICATIONS

European Patent Office 1 201 810 May 2002.*
European Patent Office 1 258 556 Nov. 2002.*

* cited by examiner

*Primary Examiner*—Frankie L Stinson
(74) *Attorney, Agent, or Firm*—Bacon & Thomas, PLLC.

(57) ABSTRACT

A drum type washing machine includes a housing; a water tub unit accommodated in the housing; a vibration damper, a lower portion thereof being fixed at a base portion of the housing; and a displacement detecting unit for detecting displacement of the water tub unit, the displacement detecting unit being disposed between the water tub unit and the base portion of the housing. The vibration damper supports the water tub unit at a position closer to a front side of the housing than the center of gravity of the water tub unit, and the displacement detecting unit is positioned closer to a rear side of the housing than the vibration damper.

8 Claims, 8 Drawing Sheets

DRUM TYPE WASHING MACHINE

FIELD OF THE INVENTION

The present invention relates to a drum type washing machine for performing washing, rinsing and water-extracting processes by rotating a rotary drum accommodating laundry therein.

BACKGROUND OF THE INVENTION

With regard to a drum type washing machine, since a rotary drum is disposed in a water tub such that its rotational axis is horizontally oriented or slanted with respect to the horizontal direction with its front portion raised, laundry and water in the rotary drum tend to gather in the lower portion of the rotary drum when the rotary drum is rotated after loading laundry therein, the condition of which tends to cause excessive vibration of the rotary drum. Particularly, just as a water-extracting process is performed after the washing and rinsing processes, the laundry in the rotary drum contains water therein and may be unbalanced toward one portion of the rotary drum due to the rotation of the rotary drum depending on the types, materials and shapes of the laundry. If the laundry is placed in such an off-balanced state during the water-extracting process in which the rotary drum is rotated at a high rpm, the water tub accommodating the rotary drum therein would vibrate considerably, thereby causing abnormal vibration or noise. In case abnormal vibration occurs, a control process to remove the unbalanced distribution of the laundry in the rotary drum is performed by stopping the rotation of the rotary drum temporarily and then resuming the rotation thereof or by lowering the rpm of the rotary drum.

In order to perform a control operation in response to abnormal vibration, various methods have been proposed for detecting such abnormal vibration promptly. For example, Japanese Patent Laid-open Application No. H6-170080 (Reference 1; see pages 2 to 3, FIG. 1) discloses a method for detecting abnormal vibration of a washing machine. In this method, a warning of excessive vibration is outputted by detecting excessive vibration based on an output current of an inverter circuit, wherein the inverter circuit controls an induction motor which rotates the rotary drum.

Moreover, Japanese Patent Laid-open Application No. H61-098286 (Reference 2; see pages 1 to 3, FIG. 1) also discloses a method for operating a washing machine. In this method, the transition from the washing cycle to the water-extracting cycle is controlled based on a vibration detection output transmitted from a vibration detecting sensor for detecting the vibration of a water tub. Here, the water-extracting operation is stopped immediately once an abnormal vibration is detected during the water-extracting cycle.

However, the method of Reference 1, which detects abnormal vibration indirectly from variations in output currents of the inverter circuit, is based on the assumption that laundry's imbalanced state is reflected by an effective current of an induction motor and that the imbalanced state leads to abnormal vibration. However, the variations in the effective current of the induction motor can be caused not only by an unbalanced distribution of laundry in the rotary drum but also by various mechanical factors, e.g., a bearing of the induction motor or the like. Further, since a set value for current in detecting an excessive vibration is determined based on the variations of the effective current, excessive vibration warnings may be given unnecessarily, thereby stopping the rotary drum too frequently.

Further, in case of the method disclosed in Reference 2 in which a vibration of the water tub is detected by a vibration detecting sensor, during the balancing operation wherein the rotary drum is rotated at a low rpm, an abnormal vibration may not yet be detected due to small amplitudes of vibration, even if there is an unbalanced distribution of laundry in the rotary drum due to laundry's clinging to an inner surface of the rotary drum. Since the amplitudes of vibration are too small to be detected until the rotational speed of the rotary drum reaches a high rpm, it tends to be difficult to detect abnormal vibration until the rotary drum is rotated at a high rpm. Therefore, there is a greater risk that the laundry or the washing machine can be damaged by abnormal vibration as the rotary drum is brought to a stop, and it will take too much longer to decelerate the rotary drum spinning at a high rpm.

SUMMARY OF THE INVENTION

It is, therefore, an object of the present invention to provide a washing machine including a displacement detector for detecting vibration of a water tub accommodating a rotary drum therein with superior precision.

In accordance with a preferred embodiment of the present invention, there is provided a drum type washing machine including: a housing; a water tub unit accommodated in the housing, the water tub unit including: a cylindrical water tub having a bottom; a cylindrical rotary drum having a bottom, and being accommodated in the cylindrical water tub; a rotating shaft fixed at the center of a bottom surface of the cylindrical rotary drum; a shaft support for supporting the rotating shaft, the shaft support being fixed to a rear bottom surface of the cylindrical water tub; and a drum driving motor connected to the rotating shaft; a vibration damper, a lower portion thereof being fixed at a base portion of the housing; and a displacement detecting unit for detecting displacement of the water tub unit, the displacement detecting unit being disposed between the water tub unit and the base portion of the housing, wherein the vibration damper supports the water tub unit at a position closer to a front side of the housing than the center of gravity of the water tub unit, and the displacement detecting unit is positioned closer to a rear side of the housing than the vibration damper.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENTS

Figure 1:
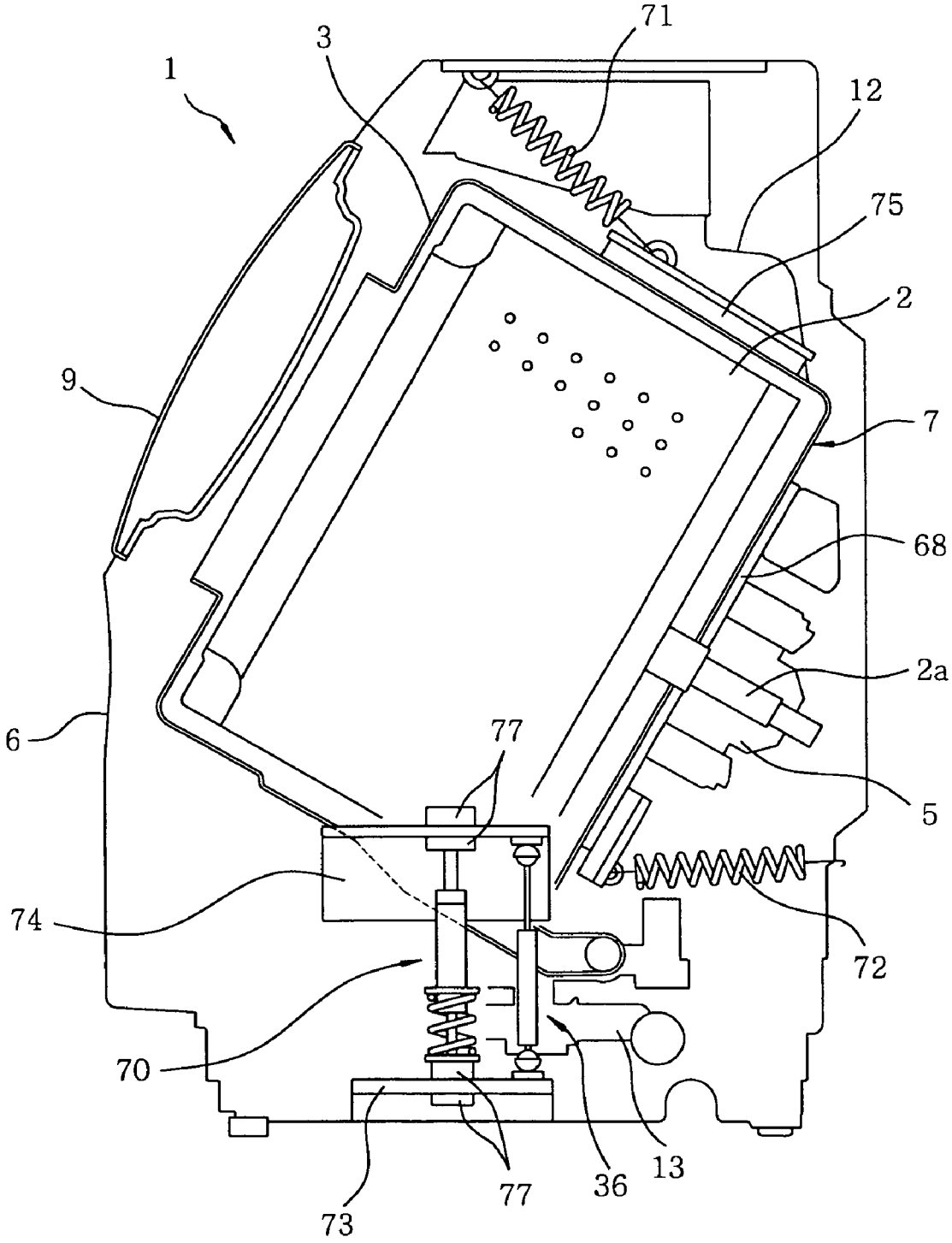
FIG. 1 shows a cross sectional view of major components of a drum type washing machine in accordance with a preferred embodiment of the present invention.

Referring to FIG. 1, there is illustrated a configuration of major components of drum type washing machine 1 in accordance with a preferred embodiment of the present invention. Water tub unit 7 including rotary drum 2, water tub 3 accommodating rotary drum 2 therein and drum driving motor 5 connected to rotating shaft 2*a* is disposed in housing 6 of washing machine 1 with water tub unit 7's front portion raised, wherein rotating shaft 2*a* of rotary drum 2 is supported by shaft support 68 provided on a rear surface of water tub 3. Since water tub unit 7 has heavy components, such as shaft support 68 and drum driving motor 5 near the rear surface thereof, the center of gravity of water tub unit 7 lies near the rear surface of water tub unit 7. This arrangement makes the water tub unit unstable. Thus, vibration damper 70 is disposed below water tub unit 7 such that it supports water tub unit 7 at a location closer to the front side than the center of gravity of water tub unit 7. Further, first coil spring 71 is installed between upper supporting part 75 fixed on the upper portion of water tub 3 and the top side of housing 6 so that water tub unit 7 is biased toward the top front portion of housing 6. Further, in addition to first coil spring 71, second coil spring 72 is installed between the rear side of housing 6 and the lower rear surface of water tub unit 7, wherein the installation point of second coil spring 72 on the lower rear surface of water tub unit 7 is at a lower level than the supporting position in water tub unit 7 by vibration damper 70. By means of first and second coil springs 71 and 72, the tendency of water tub unit 7 to fall back toward the rear side can be prevented, while forming an efficient vibration dampening structure.

Cylindrical rotary drum 2 having a base is rotatably installed in water tub 3. Rotary drum 2 is driven to rotate by drum driving motor 5, disposed at the rear side of water tub 3, and a rotational direction and a rotational speed of rotary drum 2 can be varied. Further, rotary drum 2 is slantingly disposed such that its rotational axis is declined from the front side corresponding to its opening toward the rear side corresponding to its base portion. Therefore, without a user having to bend down, laundry can be loaded into or unloaded from rotary drum 2 through opening door 9 installed at an inclined surface formed on the front side of housing 6. Moreover, since the washing machine can be operated without too much clearance space in front of drum type washing machine 1, it can be installed in a small space like a bathroom etc.

Though not shown in the drawing, drum type washing machine 1 with the above configuration also has a drying function with a fan for circulating warm air into rotary drum 2 and a heater for generating warm air. Further, a control unit is provided for controlling a series of operations including washing, rinsing, water-extracting and drying processes in sequence based on a program input by a user and an operational status monitoring of each unit.

Figure 2:
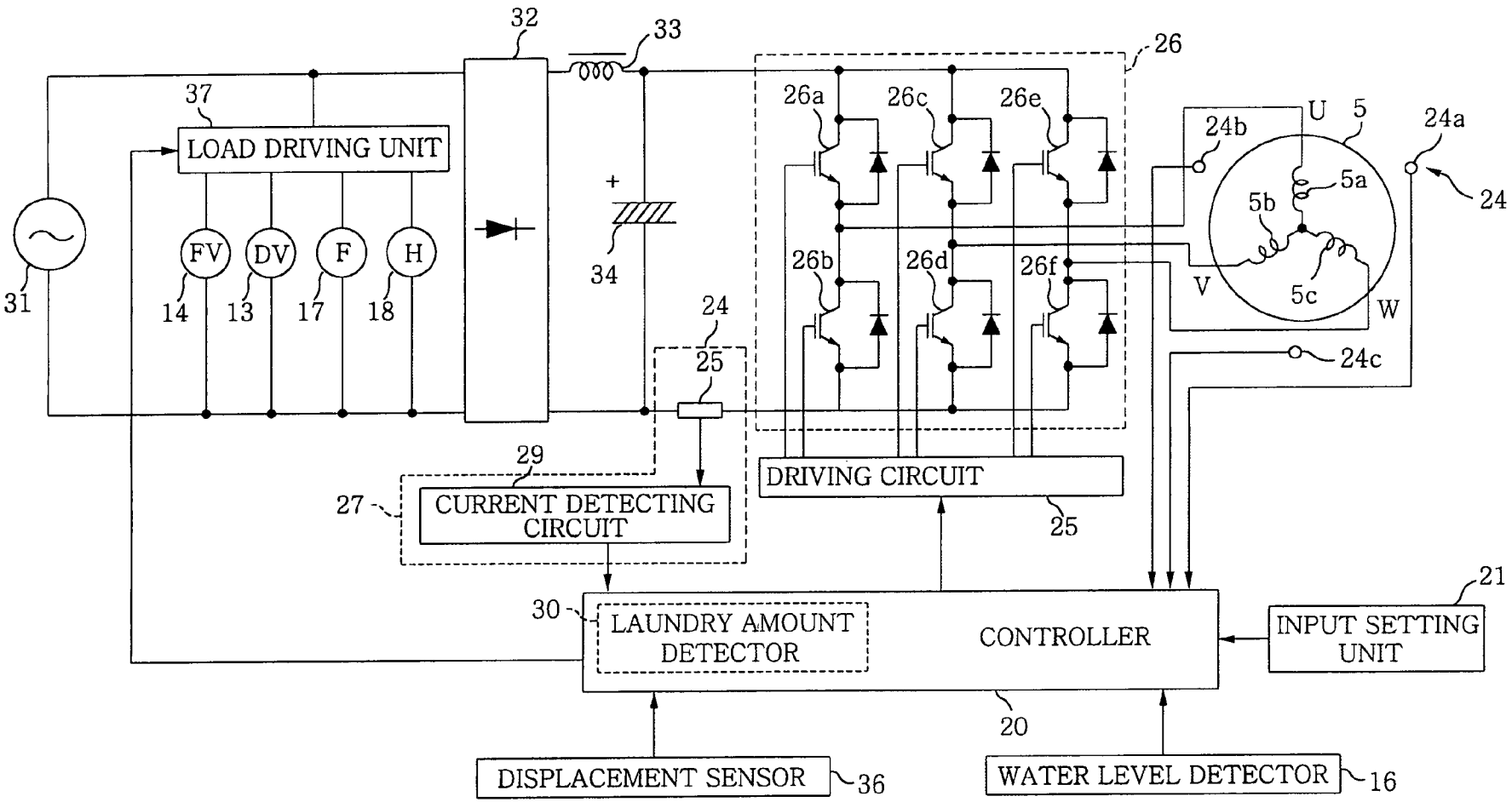
FIG. 2 sets forth a circuit diagram of a control unit of the drum type washing machine in accordance with the preferred embodiment of the present invention.

As shown in FIG. 2, the control unit rotates drum driving motor 5 by means of inverter circuit 26, wherein a DC power supplied to the inverter circuit 26 as driving power is obtained by rectifying an AC power 31 through rectifier 32 and smoothing thus obtained AC power through a smoothing circuit including choke coil 33 and smoothing capacitor 34. Further, the control unit controls the rotation of drum driving motor 5 based on a program input provided from input setting unit 21 and information upon an operational status detected by each detection unit, and also controls operations of water supply valve 14, water drain valve 13, blower 17 and heater 18 by means of load driving unit 37.

Drum driving motor 5 is a brushless DC motor including a stator with three-phase coils 5*a* to 5*c*, a rotor with a bipolar permanent magnet and three position detectors 24*a* to 24*c*, and is rotated by PWM (pulse width modification) control inverter circuit 26 including switching devices 26*a* to 26*f*. Rotor position detection signals from position detectors 24*a* to 24*c* are inputted to controller 20, and based on the signals, PWM control of the on-off status of switching devices 26*a* to 26*f* is performed by driving circuit 25. Accordingly, by regulating electric current to three-phase coils 5*a* to 5*c*, the rotor is controlled to rotate as many times as a set rotation number.

With regard to drum type washing machine 1 with the above-described configuration, when laundry is loaded into rotary drum 2 through opening door 9 and an operational option is set or an input for an operation start is executed from input setting unit 21 provided at a top portion of housing 6, drum type washing machine 1 initiates its operations corresponding to the selected operation course under the control of controller 20. The amount of laundry loaded in rotary drum 2 is detected by laundry amount detector 30, and controller 20 controls the opening/closing of water supply valve 14 such that water enters rotary drum 2 up to a water level corresponding to the laundry amount. The water level in water tub 3 is detected by water level detector 16. Specifically, the current flowing in inverter circuit 26 fluctuates depending on the load exerted on drum driving motor 5 when rotary drum 2 is rotated at a preset rotational speed. Thus, current detecting circuit 29 detects the current value from voltages at both ends of resistor 28, which is connected in series to a current circuit, and laundry amount detector 30 detects the laundry amount in rotary drum 1 based on the detected current value. Moreover, the detection of laundry amount can also be performed by means of displacement sensor 36 to be described later. In such a case, current detector 27 including resistor 28 and current detecting circuit 29 can be configured to be used in detecting the torque of drum driving motor 5.

If laundry distribution is unbalanced toward one portion of rotary drum 2 during a water-extracting process in particular, rotary drum 2 would vibrate considerably, which in turn makes water tub unit 7 vibrate as well, causing abnormal vibration or noise. Thus, in case the vibration of water tub unit 7 increases beyond a predetermined level, it is necessary to perform a control for stopping the rotation of rotary drum 2 temporarily and then resuming the rotation thereof or reducing the speed of rotary drum 2 to remove the imbalanced distribution of laundry. In order to detect the vibration of water tub unit 7, displacement sensor (displacement detecting unit) 36 is installed between lower supporting part 74, on which vibration damper 70 for supporting water tub unit 7 is installed, and supporting table 73 fixed on a base portion of housing 6 of washing machine 1.

Figure 3:
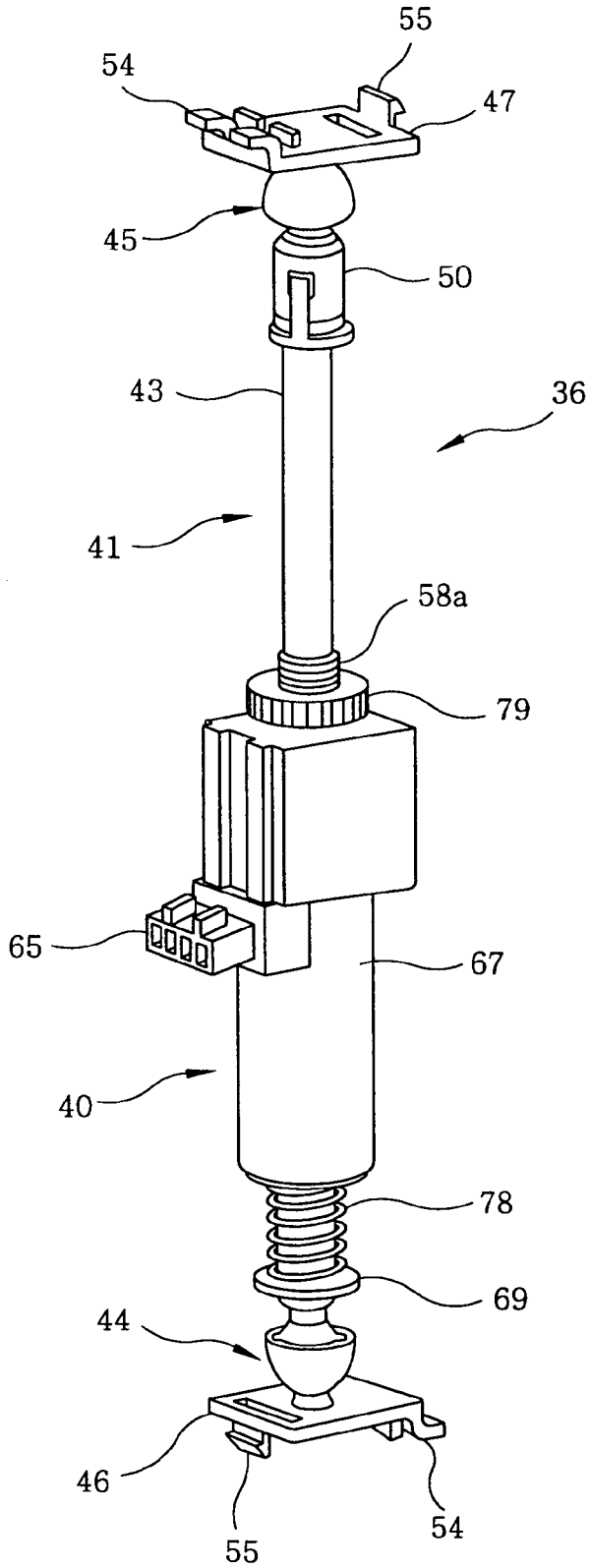
FIG. 3 presents a perspective view of a displacement sensor.
Figure 4:
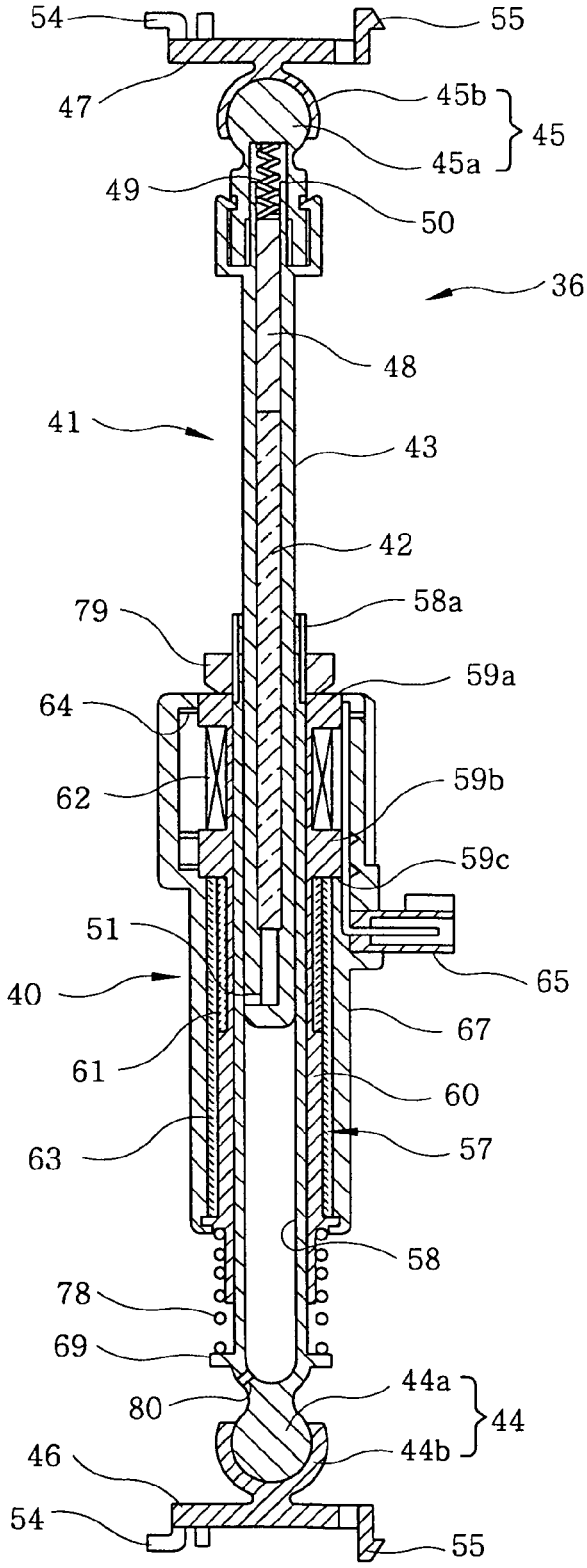
FIG. 4 provides a cross sectional view of the displacement sensor.

As shown in FIGS. 3 and 4, displacement sensor 36 includes detection coil unit 40 and displacement rod unit 41 capable of being inserted into detection coil unit 40 such that it is vertically movable within detection coil unit 40. A lower end of detection coil unit 40 is connected to lower attachment table 46 via lower connection member 44, while an upper end of displacement rod unit 41 is connected to upper attachment table 47 via upper connection member 45. Lower attachment table 46 and upper attachment table 47 are engaged with supporting plate 73 and lower supporting part 74, respectively, so that displacement sensor 36 can respond to vibration of water tub unit 7 three dimensionally and detect a displacement of water tub unit 7 from the vibration.

As illustrated in FIG. 4, detection coil unit 40 includes coil body 57 with three coils 61 to 63 wound around bobbin 60 and wired to connector 65; and cylinder body 58, wherein coil body 57 coated with resin mold body 67 is slidably fitted to the periphery of cylinder body 58 into which rod body 43 of displacement rod unit 41 is to be inserted in a way that it is vertically movable.

Figure 5:
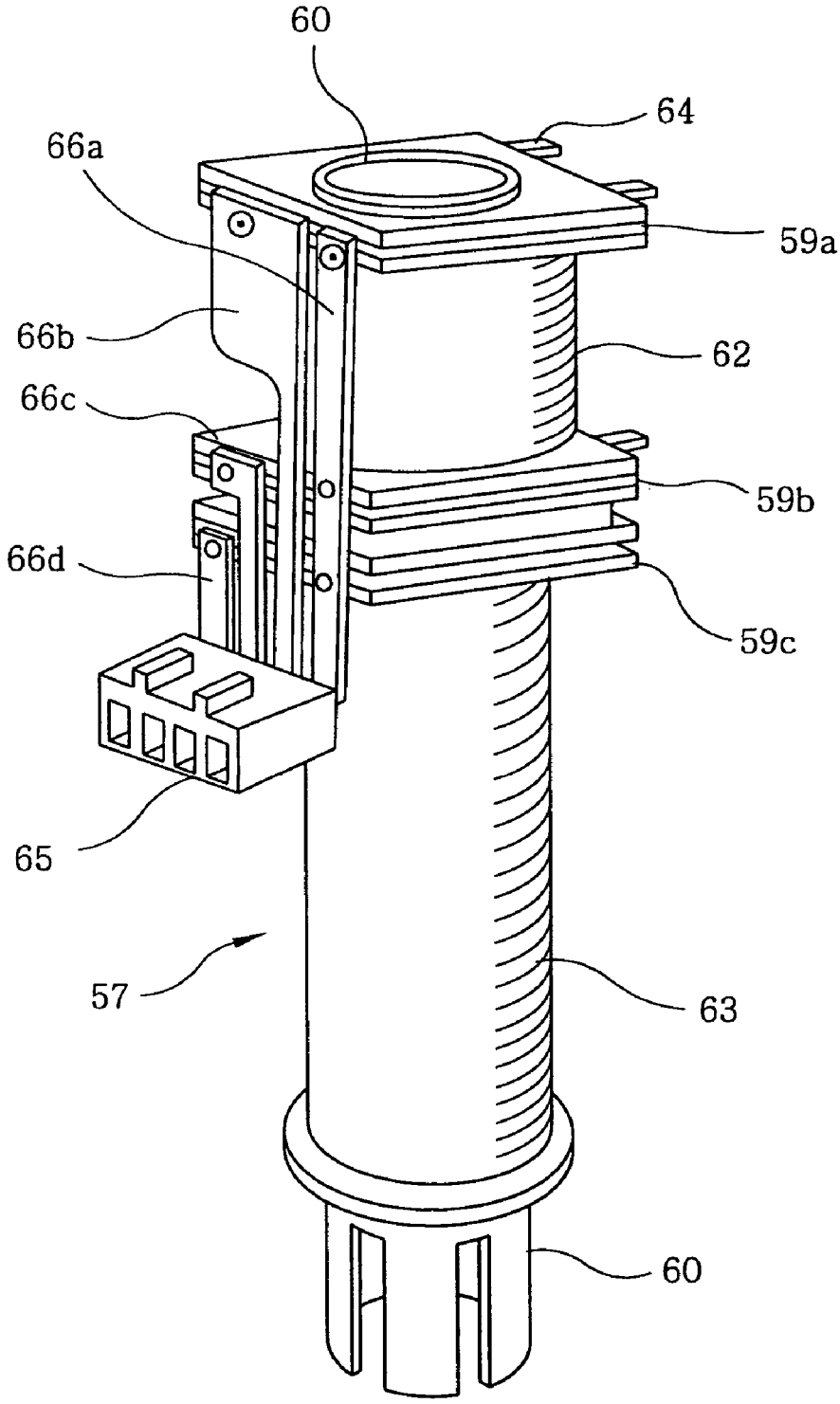
FIG. 5 shows a perspective view of a coil body which makes up the displacement sensor.
Figure 8:
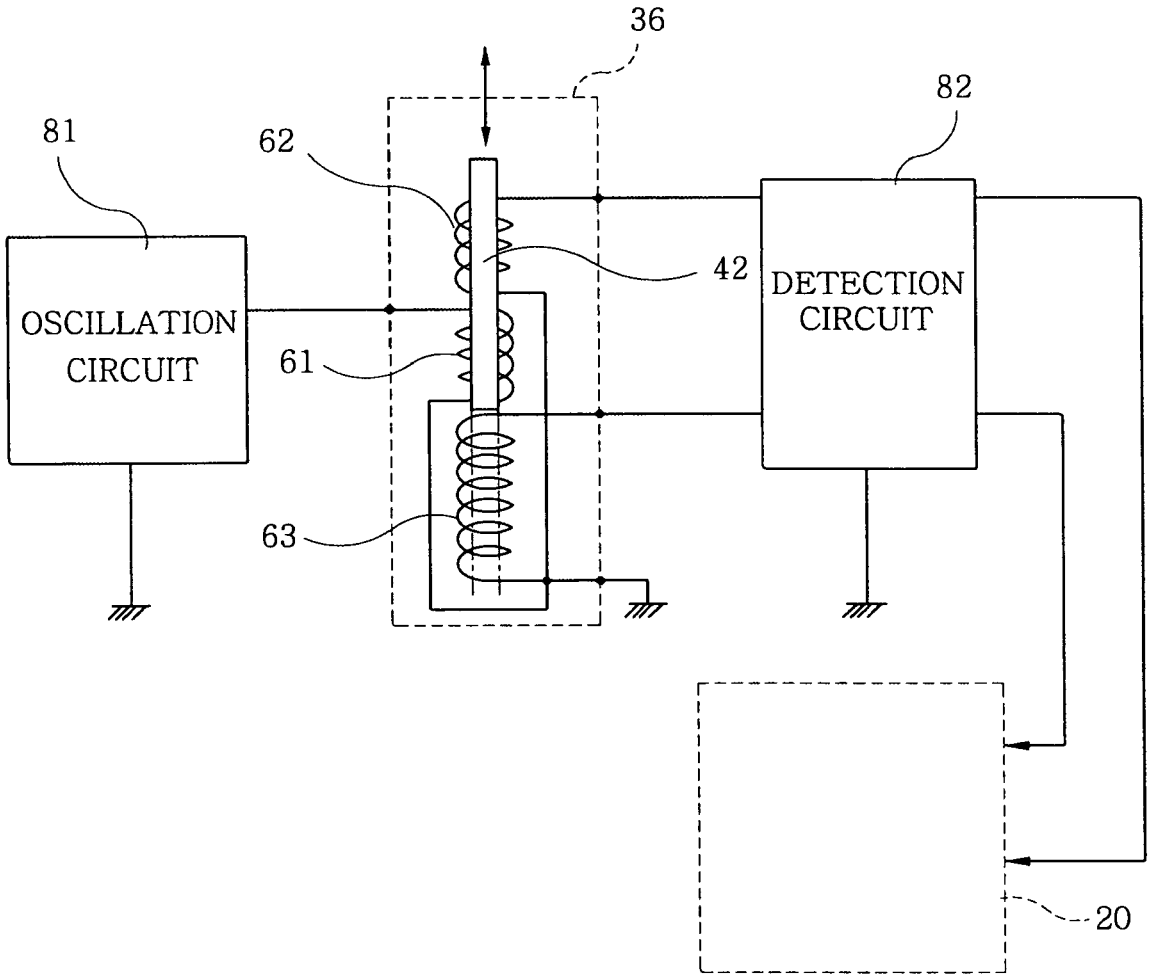
FIG. 8 provides a circuit diagram illustrating a configuration of a displacement detecting circuit using a displacement sensor.

As for coil body 57 shown in FIGS. 4 and 5, primary coil 61 is wound around an approximately central portion of bobbin 60 provided with coil connection flanges 59*a* to 59*c*, and second secondary coil 63 is coaxially wound therearound such that a portion of second secondary coil 63 covers primary coil 61. Further, first secondary coil 62 is wound between coil connection flanges 59*a* and 59*b*. Then, by soldering the ends of the respective coils to corresponding six connection members 64, each being buried in one of coil connection flanges 59*a* to 59*c*, a three-winding coil body in which three coils are wound on bobbin 60 can be obtained. As illustrated in a displacement detection circuit in FIG. 8, in order to connect one end of each coil to a ground potential while separately taking out the respective other ends externally, primary coil 61, first secondary coil 62 and second secondary coil 63 are wired to four-terminal connector 65. As shown in FIG. 5, by soldering four connection plates 66*a* to 66*d* whose one end portions serve as extensions of connection pins of four terminals of connector 65 at predetermined positions on connection member 64, each coil can be wired to connector 65 without a lead wiring. As illustrated in FIGS. 3 and 4, coil body 57 is coated with resin mold body 67 except a plug portion of connector 65 which is exposed externally, so that moisture and vibration proofing of coil body 57 can be improved.

As shown in FIG. 4, spring 78 is disposed on flange 69 formed on a lower portion of cylinder body 58 having a base. Accordingly, if coil body 57 is fitted thereto, coil body 57 is biased upward by spring 78 and, in this state, coil body 57 is fixed to cylinder body 58 by screwing nut 79 into screw portion 58*a* provided at an upper end portion of cylinder body 58. The height of coil body 57 fitted to cylinder body 58 can be adjusted by varying a screw-coupling position of nut 79. Furthermore, as shown in FIG. 5, slit portions are formed at bobbin 60's lower end portion exposed below resin mold body 67 and they are engaged with protrusions (not shown) formed at a coupling portion of spring 78 of cylinder body 58, to thereby stabilize coil body 57 on cylinder body 58 while preventing turning of coil body 57 thereon.

Displacement rod unit 41, which is inserted into cylinder body 58 of detection coil unit 40 such that it is vertically movable, includes rod body 43 having a cylindrical shape with a base, as shown in FIG. 4. Cylindrical ferrite (magnetic body) 42 is inserted into rod body 43, and spacer 48 formed of a non-magnetic material is also inserted to rest on ferrite 42. Further, pressing spring 49 is disposed on spacer 48, and cap 50 having globoid 45*a* of upper connection member 45 at its one end is screw-coupled to a screw portion formed at an upper end of rod body 43, whereby ferrite 42 is held in a certain position. By fixing ferrite 42 at the certain position by the spring bias, deformation of displacement rod unit 41 due to the difference in thermal expansion coefficients between rod body 43 made of resin and ferrite 42 can be prevented. As for the washing machine, since temperature fluctuates greatly, it is preferable to employ such a structure for preventing deformation due to thermal expansion.

Moreover, since ferrite 42 is fabricated by molding of raw material powder by pressurizing it and then sintering the molded structure, ferrite 42 is vulnerable to impact or the like. However, even though ferrite 42 is broken inside rod body 43, for example, this has no effect on its electrical property because ferrite 42 is compressed towards the step of the hollow portion by pressing spring 49. Therefore, instead of using ferrite 42 with a predetermined standard length, it is also possible to use multiple shorter ferrites stacked on top of each other, so it becomes an option whether to use a single ferrite of a standard length or to use multiple but shorter ferrites. Therefore, it is possible to use a ferrite of a standard size or a broken ferrite of a shorter size. Further, pressing spring 49 is preferably fabricated with a non-magnetic material so that the spring will not interfere with the effect of ferrite 42 having a fixed length and formed of magnetic material by serving as an extension of ferrite 42. Here, in the preferred embodiment of the present invention, however, since ferrite 42 is biased by pressing spring 49 via non-magnetic spacer 48, it is permissible form pressing spring 49 with a magnetic body, that is, pressing spring 49 can be either a magnetic or non-magnetic body. Thus, there is more option to choose in terms of selecting the material for pressing spring 49. In addition, by providing a space in the internal end side of rod body 43 and forming water discharge hole 51 opened toward the outside from the space, it becomes possible to discharge condensed water out of rod body 43 in case condensed water is generated due to temperature variations.

Since rod body 43 of displacement rod unit 41 having the above configuration is inserted into cylinder body 58 of detection coil unit 40 to move up and down therein like a piston moving in a cylinder, a friction coefficient between rod body 43 and cylinder body 58 should be small. In general, though reduction of friction coefficient is achieved by coating a lubricant such as grease on parts that are sliding against each other, it has a drawback in that fiber powder or dust particles would stick to the coated lubricant, making it impossible to maintain its performance for an extended period of time. Thus, in the preferred embodiment, rod body 43 and cylinder body 58 are formed by a combination of materials having small friction coefficients and high abrasion resistance relative to each other. For example, one of the rod body 43 and cylindrical body 58 may be formed of polyacetal while the other may be formed of polyamide, whereby friction between rod body 43 and cylinder body 58 can be reduced when rod body 43 moves relative to cylinder body 58. Further, since these materials have high abrasion resistance, endurance capacity can be improved. Further, when rod body 43 moves up and down rapidly inside cylinder body 58, air inside cylinder body 58 is compressed or expanded. Thus, in order to prevent the resistance against the vertical movement of displacement rod unit 41 due to air, it is preferred to provide in the lower end side of cylinder body 58 air discharge hole 80 opened from the inner hollow portion therein toward the outside. Air discharge hole 80 can also be used to discharge moisture or condensed water inside cylinder body 58 externally.

As described in FIG. 1, displacement sensor 36 is disposed between water tub unit 7 and the base portion of housing 6 to detect displacement of water tub unit 7. Given that the direction of the vibration of water tub unit 7 is three dimensional while the base portion of housing 6 is fixed at one position, it is necessary to provide an installation structure for displacement sensor 36 capable of preventing it from being damaged due to the vibration of water tub unit 7 or deviate from its original position.

As shown in FIGS. 3 and 4, in displacement rod unit 41, globoid 45*a* is formed at the upper end of cap 50 screw-coupled to the upper end of rod body 43, and bowl-shaped body 45*b* having an inner diameter corresponding to the diameter of globoid 45*a* is installed on upper attachment table 47 engaged with lower supporting part 74 which is fixed to water tub unit 7, wherein globoid 45*a* is fitted into bowl-shaped body 45*b*, globoid 45*a* and bowl-shaped body 45*b* serving as upper connection member 45. Further, as for detection coil unit 40, globoid 44*a* is formed at the lower end of cylinder body 58 and bowl-shaped body 44*b* is installed on lower attachment table 46 engaged with supporting table 73 which is fixed on the base portion of housing 6, wherein globoid 44*a* is fitted into bowl-shaped body 44*b*, globoid 44*a* and bowl-shaped body 44*b* serving as lower connection member 44. By using the installation structure for displacement sensor 36 having the upper and lower connection members with the above configuration, displacement sensor 36 can respond to vibration of water tub unit 7 flexibly, while taking a displacement of displacement rod unit 41 with respect to coil detection unit 40 that corresponds to the amount of vibration of water tub unit 7.

As described above, since detection coil unit 40 is provided with connector 65 and the lead is connected to connector 65, when detection coil unit 40 rotates, there is a risk that the lead connected to connector 65 may be cut off or the connection itself may be separated. Therefore, lower connection member 44 has an anti-rotation structure for preventing the rotation of detection coil unit 40 while maintaining its free movement.

Figure 6:
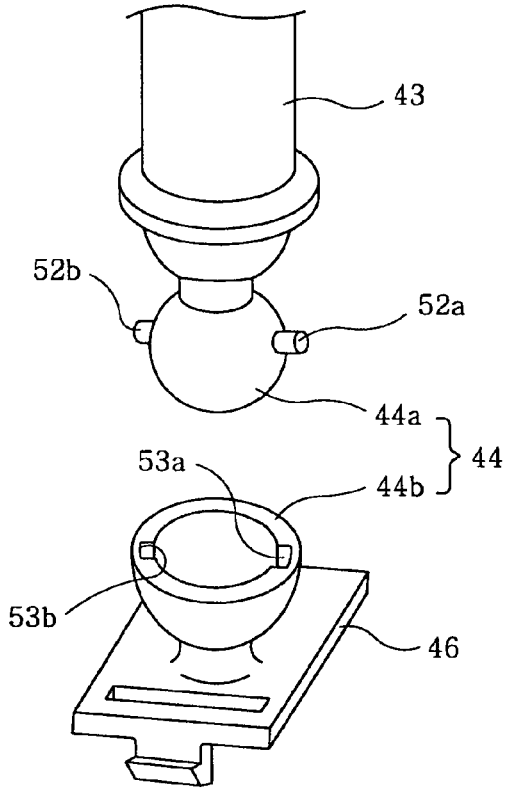
FIG. 6 illustrates a perspective view of a lower connection member.
Figure 7:
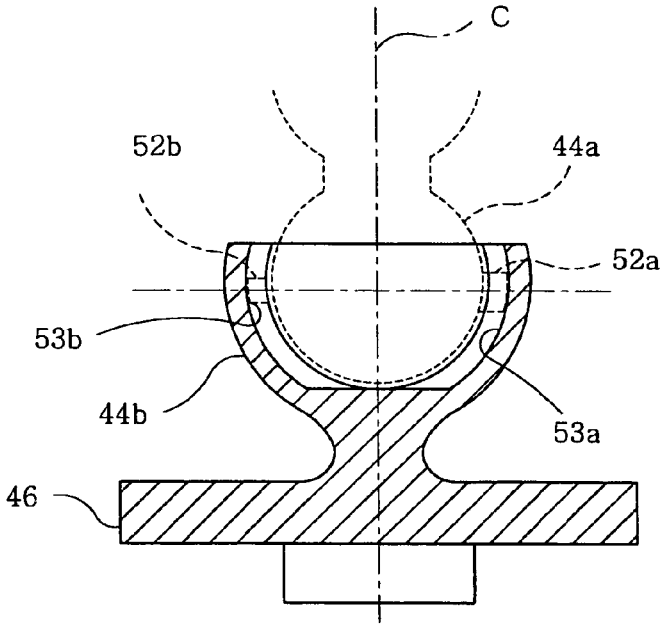
FIG. 7 offers a cross sectional view of a bowl-shaped member which makes up the lower connection member.

As shown in FIG. 6, globoid 44*a* forming lower connection member 44 is provided with a pair of cylindrical protrusions 52*a* and 52*b* that project oppositely from the sphere surface of globoid 44*a* along its diametrical direction perpendicular to the axial direction of rod body 43. Further, bowl-shaped body 44*b* to be coupled with globoid 44*a* is provided with a pair of engagement grooves 53*a* and 53*b* at its positions corresponding to cylindrical protrusions 52*a* and 52*b* of globoid 44*a*. To be specific, engagement grooves 53*a* and 53*b* are formed through the path traced by cylindrical protrusions 52*a* and 52*b* of globoid 44*a* as the central axis C of rod body 43 is tilted towards the direction cylindrical protrusions 52*a* and 52*b* are formed, this motion being made about the center of globoid 44*a*, as shown in the cross sectional view in FIG. 7. Since cylindrical protrusions 52*a* and 52*b* are formed along the globoid 44*a*'s diametrical direction, it is possible to keep cylindrical protrusions 52*a* and 52*b* engaged with engagement grooves 53*a* and 53*b* even when the central axis C of rod body 43 tilted by 360 degrees altogether. With lower connection member 44 having the above configuration, although the free movement of lower connection member 44 is maintained with respect to the detection coil unit 40's movement in the direction of 360 degrees by engaging globoid 44*a* with bowl-shaped body 44*b*, the rotation of detection coil unit 40 about the central axis can be prevented because cylindrical protrusions 52*a* and 52*b* are engaged with engagement grooves 53*a* and 53*b*. Furthermore, cylindrical protrusions 52*a* and 52*b* protruding from globoid 44*a* in opposite directions may be formed to have different diameters, and thus, engagement grooves 53*a* and 53*b* corresponding to cylindrical protrusions 52*a* and 52*b*, respectively, also have different widths. Therefore, it becomes possible to limit the installation direction of detection coil unit 40, to thereby regulate the wiring connection to connector 65 in a preset manner.

As for globoid 44*a* and bowl-shaped body 44*b* forming lower connection member 44 jointly, and globoid 45*a* and bowl-shaped body 45*b* forming upper connection member 45 jointly, globoids 44*a* and 45*a* and bowl-shaped bodies 44*b* and 45*b* are formed of combinations of materials allowing for low friction coefficient therebetween, as in the case of cylinder body 58 and rod body 43 slidingly moving therein. In the preferred embodiment of the present invention, since globoid 44*a* is formed at one end of cylinder body 58 as one body therewith, lower attachment table 46 having bowl-shaped body 44*b* formed as one body therewith and cylinder body 58 are formed of different materials allowing for a small friction coefficient therebetween. As a result, globoid 44*a* and bowl-shaped body 44*b* can be coupled to each other such that their smooth sliding movements relative to each other are allowed without having to coat a lubricant such as grease on the sliding portions. Likewise, in the case of upper connection member 45, upper attachment table 47 having bowl-shaped body 45*b* formed as one body therewith and cap 50 having globoid 45*a* formed as one body therewith are formed of different materials. One example of the combination of those materials allowing for a small friction coefficient therebetween is a set of polyacetal and polyamide.

In order to form facing members of sliding contact portions using combinations of materials allowing for a small friction coefficient as described above, it is preferable to select a material for each part of displacement sensor 36 as will be described hereinafter. Here, the sliding contact portions refer to upper and lower connection members 44 and 45, and, also, sliding portions of rod body 43 and cylinder body 58.

As described, bowl-shaped body 44*b* formed on lower attachment table 46 is provided with engagement grooves 53*a* and 53*b* to prevent the rotation of detection coil unit 40. Here, even if bowl-shaped body 45*b* installed on upper attachment table 47 is configured to have engagement grooves 53*a* and 53*b*, it does not hinder the free movement of globoid 45*a*. Accordingly, it is possible to use same parts for upper and lower attachment tables 47 and 46. Hereinafter, for simplicity, characters will be used such that the material for resin-forming upper and lower attachment table 47 and 46 is material B while the material for plastic molding cylinder body 58 and cap 50 formed as one body with globoids 44*a* and 45*b* corresponding to bowl-shaped bodies 44*b* and 45*b*, respectively, is material C. Further, the material for resin-forming rod body 43 slidingly moving inside cylinder body 58 is material B different from the material for forming cylinder body 58. Since rod body 43 has cap 50 and globoid 45*a* is formed as one body with cap 50, the above distinction of materials becomes possible, and the facing members of the sliding contact portions can be formed of materials B and C, respectively, which allows for small friction coefficients therebetween. For example, material B may be polyacetal while material C may be polyamide.

Displacement sensor 36 having the above-described configuration is installed between supporting table 73 and lower supporting part 74, on which vibration damper 70 is installed, as shown in FIG. 1. Since vibration damper 70 supports water tub unit 7 at a location closer to the front side of housing 6 than the center of gravity of water tub unit 7, as described earlier, displacement sensor 36 is installed on or near a vertical line passing through the center of gravity of water tub unit 7, i.e., at a location closer to the rear side of housing 6 than vibration damper 70. With this configuration, an average movement of water tub unit 7 can be detected, thereby improving the precision of displacement detection. In addition, in case displacement sensor 36 is installed at a location closer to the front of housing 6 than vibration damper 70, an excessively great vibration may be detected when the front side of rotary drum 2 revolves greatly, e.g., making a pounding motion. Further, by installing displacement sensor 36 on or near the vertical line passing through the center of gravity of water tub unit 7, the detection precision can be improved in case of detecting the amount of laundry loaded in rotary drum 2 by means of displacement sensor 36, as will be described later.

Further, since displacement sensor 36 can detect displacement in a direction substantially identical to the axial direction of vibration damper 70, it can detect the vibration of water tub unit 7 precisely. Moreover, since the installation of displacement sensor 36 can be accomplished by sharing the components for installing vibration damper 70, it is possible to install displacement sensor 36 securely without having to use additional components. Specifically, the attachment of displacement sensor 36 to lower supporting part 74 and supporting table 73 can be done simply by fitting engaging member 54 and hook member 55 into engagement holes provided at lower supporting part 74 and supporting table 73, wherein engaging member 54 and hook member 55 has the same structure and are formed on each of upper and lower attachment table 47 and 46, as shown in FIGS. 3 and 4. That is to say, by fitting engaging member 54 having a curved shape into a hole formed at lower supporting part 74 or supporting table 73 slantingly, and inserting hook member 55 into another hole formed at lower supporting part 74 or supporting table 73 such that upper attachment table 47 or lower attachment table 46 are arranged parallel to lower supporting part 74 or supporting table 73, a separation prevention portion of hook member 55 may be caught in said another hole, thereby enabling installation of displacement sensor 36 without using connection members such as screws.

The drum type washing machine in accordance with the preferred embodiment of the present invention employs a vibration dampening structure in which water tub unit 7 is slantingly disposed with its front portion raised, and vibration damper 70 supports water tub unit 7 at a location closer to the front portion of the washing machine than the center of gravity of water tub unit 7, and first and second coil spring 71 and 72 suspend water tub unit 7 at a predetermined position elastically. Since the function of vibration damper 70 becomes particularly noticeable in the above configuration, more precise detection of water tub unit 7's displacement can be done by installing displacement sensor 36 in the direction substantially identical to vibration dampening direction of vibration damper 70 as in the preferred embodiment of the present invention.

Detection of displacement of water tub unit 7 by displacement sensor 36 can be accomplished by connecting oscillation circuit 81 and detection circuit 82 to connector 65 installed in detection coil unit 40. In case water tub unit 7 is at a predetermined position without making a displacement, ferrite 42 locates itself at a reference position where no displacement of displacement rod unit 41 is made with respect to detection coil unit 40. Accordingly, if an triggered magnetic signal of a certain output is transmitted to primary coil 61 from oscillation circuit 81, signal outputs produced with respect to first secondary coil 62 and second secondary coil 63 are maintained at a certain level. Oscillation circuit 81 applies a sine wave or a chopping wave of a predetermined frequency to primary coil 61 as an excited magnetic signal, and detection coil circuit 82 rectifies and smoothes the signal outputs excited to first and second secondary coil 62 and 63 as a result of applying the excited magnetic signal to primary coil 61, to thereby obtain a voltage output corresponding to a displacement of water tub unit 7.

Here, the reference position refers to ferrite 42's position where its lower end locates at a position identical to the lower end of primary coil 61 when no laundry is loaded in rotary drum 2. In setting the reference position, the position of ferrite 42 within the coil can be adjusted by controlling the height position of detection coil unit 40, which is biased upward by spring 78, with respect to displacement rod unit 41 by rotating nut 79, as shown in FIG. 3. Since it is impossible to observe ferrite 42 directly, its position can be readily adjusted by rotating nut 79 such that each of output signals of first and second secondary coil 62 and 63 is outputted from detection circuit 82 as a voltage corresponding to the reference position.

Figure 9:
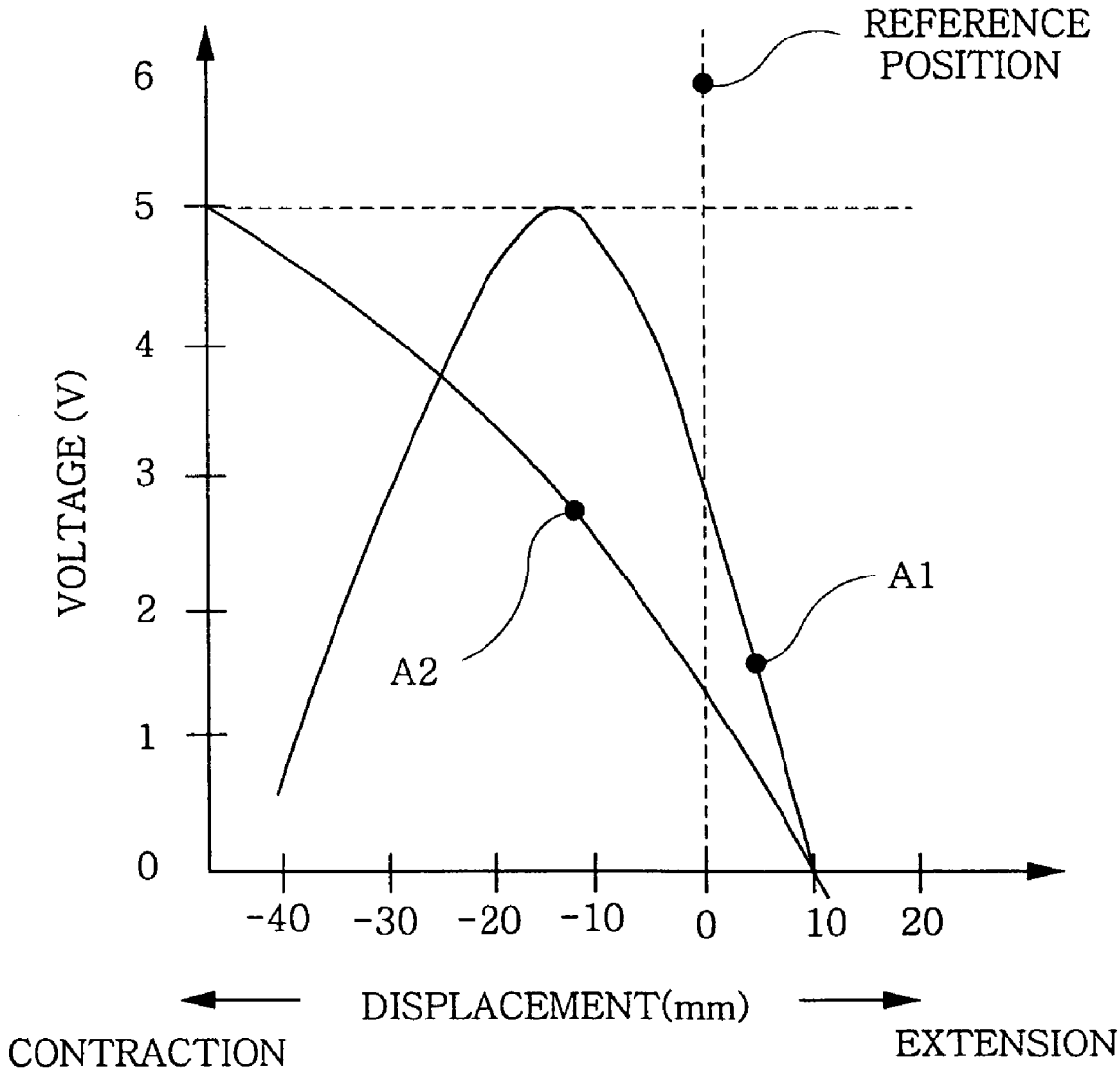
FIG. 9 sets forth a graph showing variations in output voltage of the displacement detecting circuit.

When displacement rod unit 41 moves vertically within detection coil unit 40 in response to the displacement of water tub unit 7, the position of ferrite 42 changes, so that the voltage obtained by detection circuit 82 from the output signal excited to first secondary coil 62 fluctuates as shown in graph A1 in FIG. 9. In the graph A1, the output voltage forms a virtually straight line within a range from about 10 mm on the extension side to about 15 mm on the contraction side with respect to the reference position. Since this extension and contraction range covers a state where laundry can be accommodated in rotary drum 2, the dropping level of water tub unit 7 varies depending on the amount of laundry loaded in rotary drum 2. Thus, the output voltage obtained by detection circuit 82 from first secondary coil 62 may be considered adequate for use in detecting the amount of laundry in rotary drum 2.

Meanwhile, the output voltage obtained by detection circuit 82 from the output signal excited to second secondary coil 63 fluctuates as shown in graph A2 in FIG. 9. In the graph A2, the output voltage forms a virtually straight line within a range from about 10 mm on the extension side to about 40 mm on the contraction side with respect to the reference position. Since this range covers a state where laundry is loaded in rotary drum 2 and water is supplied in water tub 3 up to a maximum level during a washing process, the variation of the output voltage obtained by detection circuit 82 from the output signal of second secondary coil 63 is preferably used in detecting displacement from the vibration of water tub unit 7.

By inputting the two voltage variations obtained by detection circuit 82 to controller 20 (see FIG. 2), controller 20 can obtain two kinds of displacement detection information regarding the detection of laundry amount and vibration of water tub unit 7, which results in reliably controlling drum type washing machine 1. That is, in the initial stage of starting the operation of washing machine 1, the dropping level of water tub unit 7 varies depending on the amount of laundry loaded in rotary drum 2. Therefore, controller 20 detects the amount of laundry based on a displacement of water tub unit 7 using an output voltage of detection circuit 82 obtained from first secondary coil 62, and controls the opening/closing of water supply valve 14 to supply wash water up to a level corresponding to the laundry amount, to thereby control operations, e.g., the setup of duration of washing, rinsing and water-extracting processes based on the laundry amount precisely. Further, if the variation amount of the voltage obtained from the output signal excited to second secondary coil 63 of displacement sensor 36 is great while controller 20 controls the series of processes, controller 20 determines that abnormality has occurred and stops the rotation of drum driving motor 5, whereas it reduces the rpm of rotary drum 2 or stops the rotation of rotary drum 2 temporarily and then resumes the rotation thereof. As a consequence, abnormal vibration or noise can be prevented.

In accordance with the present invention as described above, a displacement of the water tub unit can be detected by means of the displacement sensor disposed below the center of gravity of water tub unit suspended in the housing of the washing machine via a vibration dampening structure. Therefore, it is possible to detect the displacement of the water tub unit precisely, which in turn makes it possible for the controller to perform precise control based on the amount of laundry or water. Thus, the amount of laundry loaded in the rotary drum or the occurrence of vibration due to the imbalanced distribution of laundry in the rotary drum can be detected with superior precision. Therefore, since the washing machine in accordance with the present invention can perform control operations based on the detection of the displacement of the water tub unit, abnormal vibration can be prevented without causing damage on laundry loaded or the washing machine itself.

While the invention has been shown and described with respect to the preferred embodiments of the present invention, it will be understood by those skilled in the art that various changes and modifications may be made without departing from the spirit and scope of the invention as defined in the following claims.

What is claimed is:

1. A drum type washing machine comprising:

a housing;

a water tub unit accommodated in the housing, the water tub unit including:

a cylindrical water tub having a bottom;

a cylindrical rotary drum having a bottom, and being accommodated in the cylindrical water tub;

a rotating shaft fixed at the center of a bottom surface of the cylindrical rotary drum;

a shaft support for supporting the rotating shaft, the shaft support being fixed to a rear bottom surface of the cylindrical water tub; and a drum driving motor connected to the rotating shaft;

a vibration damper, a lower portion thereof being fixed at a base portion of the housing; and a displacement detecting unit that detects displacement of the water tub unit, the displacement detecting unit being disposed between the water tub unit and the base portion of the housing, wherein the vibration damper supports the water tub unit at a position closer to a front side of the housing than the center of gravity of the water tub unit, and the displacement detecting unit is positioned closer to a rear side of the housing than the vibration damper.

2. The washing machine of claim 1 wherein the displacement detecting unit is installed to detect displacement of the water tub unit in a direction substantially identical to an axial direction of the vibration damper.

3. The washing machine of claim 2, wherein the water tub unit is disposed in the housing such that a rotational axis of the rotary drum is declined toward a rear side of the housing.

4. The washing machine of claim 1, wherein the water tub unit is disposed in the housing such that a rotational axis of the rotary drum is declined toward a rear side of the housing.

5. A drum type washing machine comprising:

housing;

water tub unit accommodated in the housing, the water tub unit including:

a cylindrical water tub having a bottom;

a cylindrical rotary drum having a bottom, and being accommodated in the cylindrical water tub;

a rotating shaft fixed at the center of a bottom surface of the cylindrical rotary drum;

a shaft support for supporting the rotating shaft, the shaft support being fixed to a rear bottom surface of the cylindrical water tub; and a drum driving motor connected to the rotating shaft;

a vibration damper, a lower portion thereof being fixed at a base portion of the housing; and a displacement detecting unit for detecting displacement of the water tub unit, the displacement detecting unit being disposed between the water tub unit and the base portion of the housing, wherein the vibration damper supports the water tub unit at a position closer to a front side of the housing than the center of gravity of the water tub unit, and the displacement detecting unit is positioned closer to a rear side of the housing than the vibration damper, and wherein the displacement detecting unit is disposed near a vertical line passing through the center of gravity of the water tub unit.

6. The washing machine of claim 5, wherein the displacement detecting unit is installed to detect displacement of the water tub unit in a direction substantially identical to an axial direction of the vibration damper.

7. The washing machine of claim 6, wherein the water tub unit is disposed in the housing such that a rotational axis of the rotary drum is declined toward a rear side of the housing.

8. The washing machine of claim 5, wherein the water tub unit is disposed in the housing such that a rotational axis of the rotary drum is declined toward a rear side of the housing.

* * * * *